US005472517A

United States Patent [19]

Laberge

[11] Patent Number: 5,472,517

[45] Date of Patent: Dec. 5, 1995

[54] VACUUM HEAD FOR CLEANING SURFACES, INSIDE A WATER POOL, AND A METHOD THEREFOR

[76] Inventor: Jolain Laberge, 10 Lelievre, Mercier, Qc, J6R 1Z1, Canada

[21] Appl. No.: 306,986

[22] Filed: Sep. 16, 1994

[51] Int. Cl.[6] ..... E04H 4/16

[52] U.S. Cl. ..... 134/21; 15/1.7; 15/345

[58] Field of Search ..... 15/1.7, 345, 346, 15/321, 322, 415.1; 134/21

[56] References Cited

U.S. PATENT DOCUMENTS

| | | | |
|---|---|---|---|
| 1,792,975 | 2/1931 | Gilbert | 15/398 |
| 2,497,435 | 2/1950 | Branneman | 15/345 |
| 2,646,889 | 7/1953 | Dulak | 15/1.7 |
| 3,161,900 | 12/1964 | Hornschurch et al. | 15/345 |
| 3,678,534 | 7/1972 | Hilbig | 15/345 |
| 3,958,298 | 5/1976 | Cannan | 15/322 |
| 4,168,562 | 9/1979 | Maasberg | 15/322 |
| 4,788,739 | 12/1988 | Brewer et al. | 15/322 |
| 4,864,681 | 9/1989 | Hult et al. | 15/398 |

FOREIGN PATENT DOCUMENTS

| | | | |
|---|---|---|---|
| 534298 | 9/1931 | Germany | 15/345 |
| 7712207 | 5/1979 | Netherlands | 15/1.7 |
| 0639519 | 12/1978 | U.S.S.R. | 15/345 |
| 6405 | of 1905 | United Kingdom | 15/345 |
| 362578 | 12/1931 | United Kingdom | 15/1.7 |
| 969847 | 9/1964 | United Kingdom | 15/1.7 |

*Primary Examiner*—Edward L. Roberts, Jr.
*Attorney, Agent, or Firm*—Antoine H. Gauvin

[57] ABSTRACT

A vacuum head having a confinement zone with a portion of surfaces inside a water pool, under the vacuum head, for cleaning surfaces of the floor and adjacent sides, inside a water pool. A water outlet is mounted within the confinement zone, whereby the presence of water in the confinement zone generates a flow of water driven toward the water outlet. A plurality of water jets within the confinement zone impinge water upon the portion of surfaces, under the vacuum head, for the water from the water jets to hit the portion of surfaces within the confinement zone, to remove dirt from said portion of surfaces, and said dirt together with said water to be substantially confined within the confinement zone, and be displaced along the flow of water driven toward the water outlet. A method for cleaning surfaces of the floor and adjacent sides comprises creating a negative pressure zone at least partially impermeable to the water inside a water pool to obtain a confinement zone having a flow of water driven toward said water outlet, and inside said negative pressure zone, impinging water upon surfaces for cleaning inside a water pool.

19 Claims, 2 Drawing Sheets

VACUUM HEAD FOR CLEANING SURFACES, INSIDE A WATER POOL, AND A METHOD THEREFOR

BACKGROUND OF THE INVENTION

1. Field of the Invention

This invention relates to a vacuum head for cleaning surfaces of the floor and adjacent sides, inside a water pool, and to a method of cleaning inside a water pool. This invention relates in a preferred embodiment to a one-piece vacuum head for cleaning surfaces inside a water pool, said vacuum head being provided with a two-section arm.

2. Description of Related Art

As far as Applicant is aware, the existing vacuum heads which are known using water pool facilities i.e. city tap water having a municipal watertap pressure, and a water pump for pools, are provided only with suction or with suction and a brush. Such devices, when used, give the impression of resulting in a clean pool. However within a day, a suspension in the pool returns to the bottom, indicating that the dirt that was expected to be removed, was in part put in suspension during the cleaning process.

SUMMARY OF THE INVENTION

The invention aims at cleaning surfaces inside water pools while reducing suspension, and overcoming at least in part, the above identified problem.

In a preferred embodiment, this invention aims at cleaning surfaces inside water pools while reducing dirt suspension in water, with the minimum structure requirement, and reducing the cleaning period.

Broadly stated the invention is directed to a vacuum head for cleaning surfaces of the floor and adjacent sides, inside a water pool, said vacuum head defining a confinement zone with a portion of surfaces inside a water pool, under said vacuum head, and a water outlet mounted within said confinement zone, whereby the presence of water, in said confinement zone, generates a flow of water driven toward said water outlet, and a plurality of water jets, within said confinement zone, directed to impinge water upon said portion of surfaces inside a water pool, under said vacuum head, for said water from said water jets to hit said portion of surfaces inside a water pool, under said vacuum head within said confinement zone, to remove dirt from said portion of surfaces, and said dirt together with said water to be substantially confined within said confinement zone, and be displaced along said flow of water driven toward said water outlet.

The invention is also directed to a method for cleaning surfaces of the floor and adjacent sides inside a water pool, said method comprising:

creating with a water outlet, a negative pressure zone at least partially impermeable to the water inside a water pool to obtain a confinement zone having a flow of water driven toward said water outlet, and inside said negative pressure zone, impinging water upon surfaces for cleaning inside a water pool, whereby said water hits said surfaces inside a water pool within said confinement zone, to remove dirt from said portion of surfaces, and said dirt together with said water are substantially confined within said confinement zone, and displaced along said flow of water driven toward said water outlet.

In a preferred embodiment the invention is directed to a vacuum head for cleaning surfaces of the floor and adjacent sides, inside a water pool, said vacuum head comprising:

a top, a lip downwardly extending from said top, and defining with said top, and in cooperation with a portion of surfaces inside a water pool, under said vacuum head, a confinement zone within said vacuum head, a water outlet having one end and another end, said one end connected through said top within said lip, and said another end for joining a water pump, said lip cooperating with said top and said water outlet to create a negative pressure between said top, said lip, and said portion of surfaces inside a water pool, under said vacuum head, a plurality of water jets disposed between said lip and said water outlet, and near said lip; and directing water toward said portion of surfaces inside a water pool, under said vacuum head, and in a direction toward said water outlet, whereby said jets remove the dirt along said surface to be cleaned in a water pool, creating a suspension momentarily withheld within boundaries as defined by said lips and said top and then removed from said water pool via said water outlet.

Further embodiments of the invention will be described herein below.

DESCRIPTION OF THE DRAWINGS

In the drawings which illustrate some of the preferred ways of carrying out the invention.

DESCRIPTION OF SOME OF THE PREFERRED WAYS OF CARRYING OUT THE INVENTION

Figure 1:
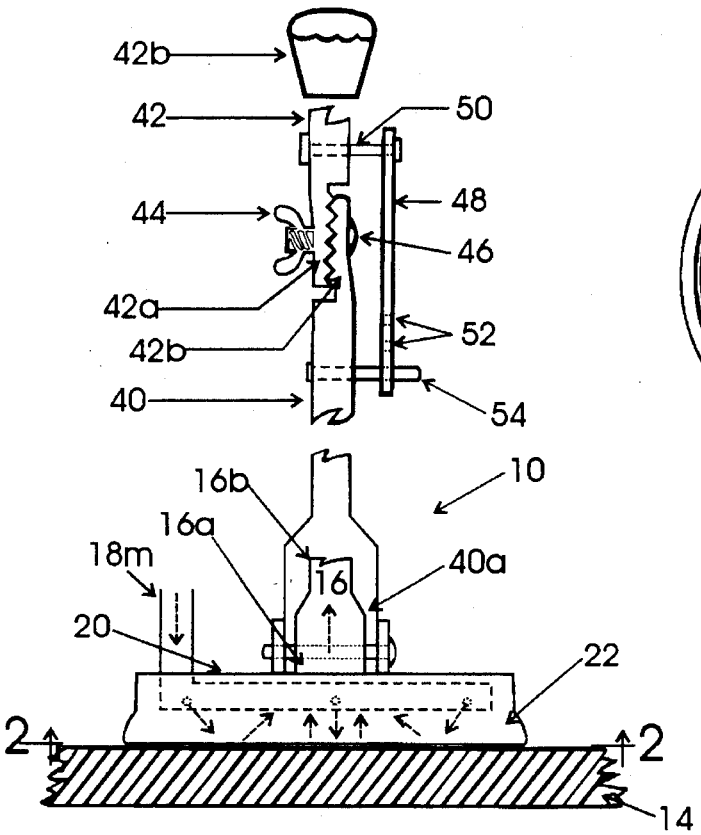
FIG. 1 is a face view of a vacuum head for cleaning surfaces of the floor and adjacent sides, inside a water pool.
Figure 2:
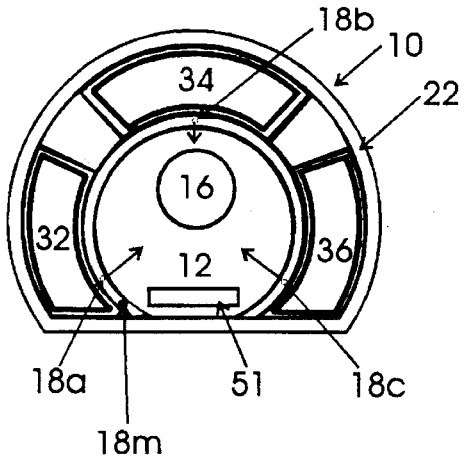
FIG. 2 is a view taken along line 2—2 of FIG. 1.

As shown in FIGS. 1 and 2, a vacuum head 10 for cleaning surfaces of the floor and adjacent sides, inside a water pool, defines a confinement zone 12 with a portion of surfaces inside a water pool 14, under said vacuum head.

A water outlet 16 is mounted within said confinement zone, whereby the presence of water in said confinement zone generates a flow of water driven toward said water outlet, and a plurality of water jets represented as 18*a*, 18*b* and 18*c*, within said confinement zone 12 are directed to impinge water upon said portion 14 of surfaces inside a water pool, under said vacuum head, for said water from said water jets to hit said portion 14 of surfaces inside a water pool, under said vacuum head 10 within said confinement zone, to remove dirt from said portion of surfaces, and said dirt together with said water to be substantially confined within said confinement zone 12, and be displaced along said flow of water driven toward said water outlet 16 as shown in FIG. 1 by the dotted arrows.

In a particular embodiment, the vacuum head for cleaning surfaces of the floor and adjacent sides, inside a water pool, comprises:

a top 20, a lip 22 downwardly extending from said top 20, and defining with said top, and in cooperation with a portion of surfaces inside a water pool, under said vacuum head, a shallow confinement zone 12 within said vacuum head, a water outlet 16 having one end and another end, said one end 16*a*, connected through said top 20 within said lip 22, and said another end 16*b* for joining a water pump, said lip 22 cooperating with said top 20 and said water outlet 16 to create a negative pressure between said top, said lip, and said portion 14 of surfaces inside a water pool, under said vacuum head, a plurality of water jets represented as 18*a*, 18*b* and 18*c*, disposed between said lip 22 and said water outlet 16, and in a particular embodiment near said lip; and directing water toward said portion 14 of surfaces inside a water pool, under said vacuum head as shown by the arrows of FIG. 1, and in a direction toward said water outlet 16 as shown in FIG. 2, whereby said jets remove the dirt along said portion 14 of surfaces to be cleaned in a water pool, creating a suspension momentarily withheld within boundaries as defined by said lip and said top and then removed from said water pool via said water outlet.

The water jets are to be connected to a positive pressure water source, for instance, via a male element 18*m* and for a hose to be mounted thereon.

In a preferred embodiment, as shown in FIG. 1, the water of the water jets impinges water at an angle of 45°±15° with the portion of surfaces inside a water pool, under said vacuum head within said confinement zone, and as shown in FIG. 2 toward said water outlet 16.

The lip 22 may be continuous as shown in FIG. 2, but need not be, depending upon the vacuum or negative pressure generated in the water outlet 16 and the water delivered from the water from the water jets. In general for a hand operated vacuum head, the suction provided is sufficient to hold the vacuum head against a portion of surfaces inside a water pool which is vertically positioned but without creating more adherence which would inhibit the displacement of the vacuum head. As a way of example only, a pump removing from 40 to 60 gallons of water per minute has been found satisfactory. For a robot the vacuum should be less so as to allow the automatic displacement.

As shown in FIG. 2, the vacuum head has a top 20 which is a semicircular flat plate or a circular flat plate cut by a secant which defines the rear of the vacuum head. This flat rear easing cleaning in the corners. Crescent-like flat plates or semicircular flat plates may be used if desired. The plate has a circular front, and said flat plate further includes weights such as 32, 34 and 36 equally disposed adjacent to said circular font, between said lip 22 and at least some of said water jets. These weights may act as baffle means to enhance confinement in said confinement zone.

It is the water jets which displace the dirt from the portion 14 of surfaces inside a water pool, under said vacuum head as shown by the arrows of FIG. 1, contrary to conventional vacuum heads. The turbulence which generates dirt suspension is limited to the confinement zone, before being drawn out by the water outlet. This new vacuum head is particularly useful in outdoor, off-ground swimming pools where the bottom is non-uniform and there are foot prints.

In a preferred embodiment, as shown in FIG. 1 and 2, the vacuum head has mounted thereon an angularly adjustable, and bendable two-section arm, comprising:

a first arm section 40 having one end 40*a* and the other end 40*b*, and a second arm section 42 having one end 42*a* and the other end 42*b*, said first arm section at said one end 40*a* to be pivotally mounted to said vacuum head over said top of said vacuum head, and said other end 40*b* of said first arm being pivotally mounted to said one end 42*a* of said second arm section, and said other end of said second arm portion defining a handle 42*b* or a coupling means, and means for releasably holding said first arm section relative to said second arm section, whereby said handle is inclined with respect to said first arm section for said handle to be oriented at a suitable angle relative to the vacuum head.

There are numerous ways to obtain the means for releasably holding the first arm section relative to said second arm section; the first arm 40 being pivotally mounted to said one end 42*a* of said second arm section, may be pivoted about a pivot, for instance: a wing nut 44 and bolt 46, to frictionally engage the two arms 40, 42 together. Said other end 40*b* of said first arm being pivotally mounted to said one end 42*a* of said second arm section, may even be corrugated as shown in FIG. 1 to increase friction; or the two arms may be connected to a locking bar 48 rotatably mounted at one end to one arm, for instance with pivot 50 and the other end of the bar may be provided with female openings such as 52 for receiving a pin fixed to the other arm such as 54; or the locking bar 48 may be provided with the pin 54 and the other arm such as 40 with the female openings. Other means for releasably holding the first arm section relative to said second arm section may also be used if desired.

Figure 3:
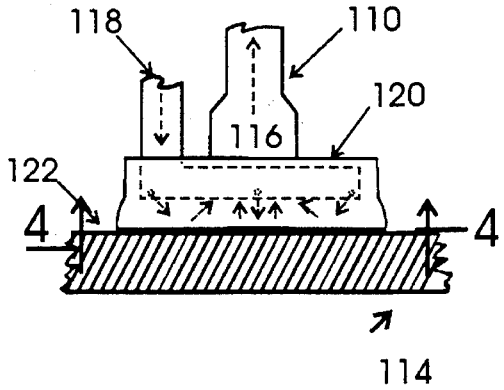
FIG. 3 is a side view of another vacuum head for cleaning surfaces of the floor and adjacent sides, inside a water pool.
Figure 4:
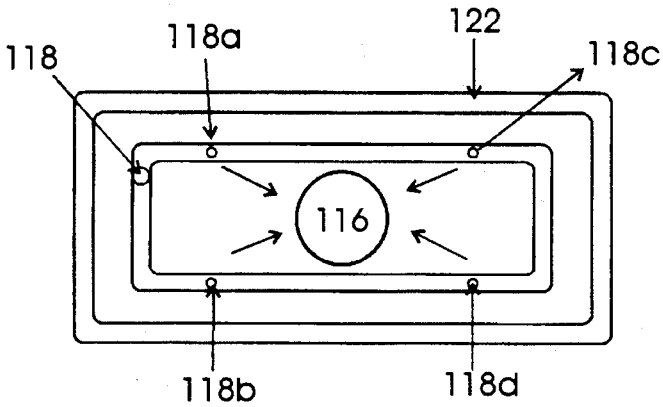
FIG. 4 is a view taken along line 4—4 of FIG. 3.

As shown in FIGS. 3 and 4, in another vacuum head 110 for cleaning surfaces of the floor and adjacent sides, inside a water pool, the top 120 is rectangular, a lip 122 is downwardly extending from said top 120, the water outlet 116 being centered on said top 120, a water line 118 having a plurality of water jets represented as 118*a*, 118*b*, 118*c* and 118*d*, equally near said lip 122 about said water outlet 116, and directing water toward said portion 114 of surfaces inside a water pool, under said vacuum head, and in a direction toward said water outlet 116 as shown in FIGS. 3 and 4. If desired, the lip 122 may also define therein the water line 118 and be perforated to define the water jets represented as 118*a*, 118*b*, 118*c* and 118*d*. This also serve as an example illustrating that the vacuum head may be mono-coque in which all the parts described form an integral body. The same may also apply to the other examples described in the other Figures herein.

As shown in FIGS. 1–4 the lip is a peripheral lip around said top, but needs not be as will be shown herein below.

Figure 5:
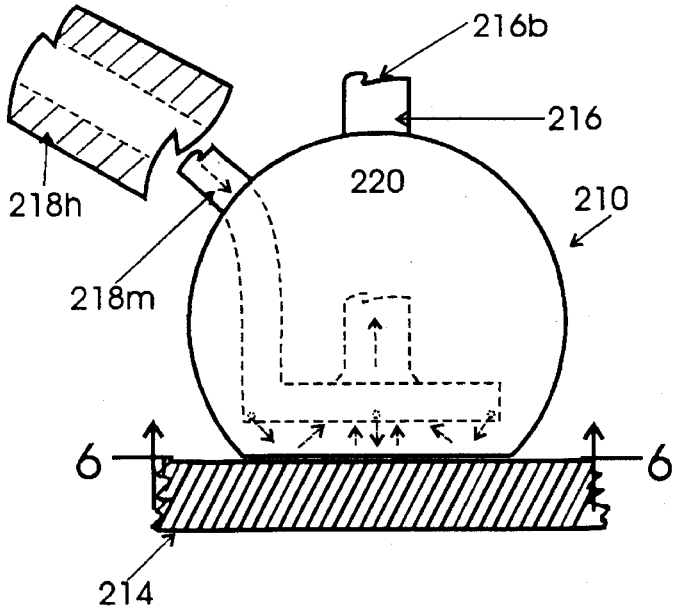
FIG. 5 is a side view of another vacuum head for cleaning surfaces of the floor and adjacent sides, inside a water pool.
Figure 6:
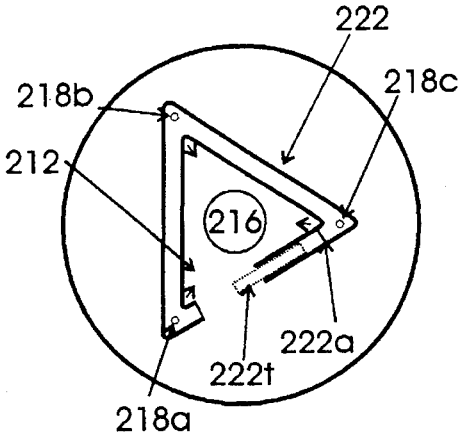
FIG. 6 is a view taken along line 6—6, of FIG. 5.

As shown in FIGS. 5 and 6, in another vacuum head 210 for cleaning surfaces of the floor and adjacent sides, inside a water pool, the top 220 is the top of a conventional robot, a lip 222 downwardly extending from said top 220, and defining with said top, and in cooperation with a portion of surfaces inside a water pool, under said vacuum head, a shallow confinement zone 212 within said vacuum head, a water outlet 216 having one end and another end, said one end connected through said top 220 within said lip 222, and said another end **216*b* for joining a water pump, said lip 222 cooperating with said top 220 and said water outlet 216 so as to create a negative pressure between said top, said lip, and said portion 214 of surfaces inside a water pool, under said vacuum head, a plurality of water jets represented as 218*a*, 218*b* and 218*c*, disposed between said lip 222 and said water outlet 216, and in a particular embodiment from said lip; and directing water toward said portion 214 of surfaces inside a water pool, under said vacuum head as shown by the arrows of FIG. 5, and in a direction toward said water outlet 216 as shown in FIG. 6, whereby said jets automatically remove the dirt along said portion 214** of surfaces to be cleaned in a water pool, creating a suspension momentarily withheld within boundaries as defined by said lip and said top and then removed from said water pool via said water outlet.

The water jets are to be connected to a positive pressure water source, for instance, via a male element **218*m* and a foam covered hose 218*h*, at least in part in order to obtain buoyancy of said hose 218*h***.

Figure 7:
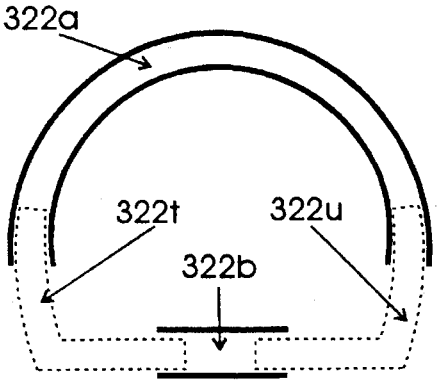
FIG. 7 is a view taken along line 2—2 of FIG. 1, of another lip.

Also as shown in FIG. 6, the lip needs not be continuous, and may be discontinuous; for instance the lip 222 may be closed inside at **222*a* adjacent said water jet 218*c* and has telescopically mounted therein a tube 222*t* for adjusting the vacuum or negative pressure inside said confinement zone 212; or as shown in FIG. 7 the lip 222 may be segmented such as 322*a* and 322*b* and have telescopically mounted therein a tube 322*t* and 322*u***.

Figure 9:
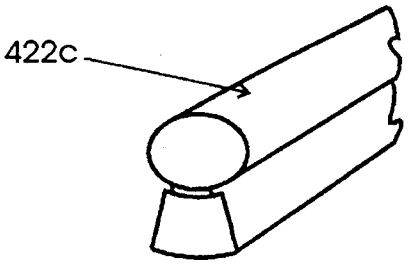
FIG. 9 is an enlarged perspective view of a portion of the segment 422*c* of FIG. 8.
Figure 8:
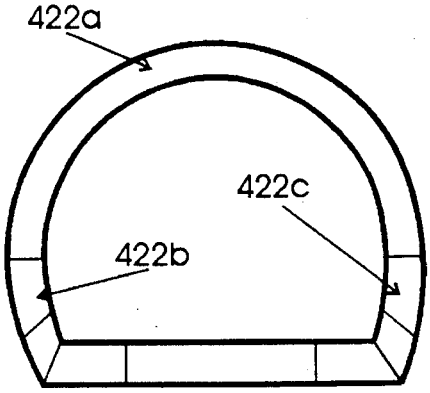
FIG. 8 is a view taken along line 2—2 of FIG. 1, of a snap on segmented lip with a segment aside.

As shown in FIG. 8, the segments may be snap-on lip segments **422*a*, 422*b*, 422*c* and the like, one of which is shown enlarged in FIG. 9, at 422*c*** haing a trapezoid cross-section portion to act as a snap-on, and terminating into a rounded free end, said rounded free end haing a rounded peripheral cross-section, for contacting with a portion of surfaces inside a water pool.

In a particular embodiment, it has been found that a vacuum head having from 2 to 5 water jets, was sufficient to accomplish a good cleaning action.

Using a water tap from the city, having a pressure of 50 psi, it has been found that water jets having an aperture ranging from ⅛ inch to ¼ inch in diameter, and preferably ⅛ inch were giving the debit and the impulse for a good cleaning. These are given as ways of example only.

The distance of the water jets from the water outlet has been found to be preferably within 2.5±1.5 inches.

The confinement zone further may include therein a member selected from the group consisting of scrubbing and brushing devices disposed away from the paths traced out by the water of said water jets to said water outlet as seen in FIG. 2, at 51.

As can be clearly seen a new method for cleaning surfaces of the floor and adjacent sides inside a water pool has been invented, said method comprises:

creating with a water outlet, a negative pressure zone at least partially impermeable to the water inside a water pool to obtain a confinement zone having a flow of water driven toward said water outlet, and inside said negative pressure zone, impinging water upon surfaces for cleaning inside a water pool, whereby said water hits said surfaces inside a water pool within said confinement zone, to remove dirt from said portion of surfaces, and said dirt together with said water are substantially confined within said confinement zone, and displaced along said flow of water driven toward said water outlet.

While some of the preferred embodiments have been described herein above, it is to be understood that the invention is not to be construed as limited to these preferred embodiments, as many modifications and variations are possible within the spirit and scope of the appended claims.

I claim:

1. A manually displaceable vacuum head to be used with water pool facilities having a water pump and a water source having a municipal water-tap pressure, for cleaning surfaces of the floor and adjacent sides, inside a water pool containing water, said vacuum head having a lip mounted on said vacuum head, downwardly extending from said vacuum head, and terminating into a rounded free end, for contacting with a portion of surfaces inside a water pool, said rounded free end having a rounded peripheral cross-section, said vacuum head defining with said lip, a shallow confinement zone with a portion of surfaces inside a water pool, under said vacuum head, and a water outlet to be connected to a water pump generating a vacuum, said water outlet being mounted within said confinement zone, and away from said portion of surfaces, whereby the presence of water in said confinement zone generates a flow of water driven away from said portion of surfaces inside a water pool, and toward said water outlet, at least some of said water to be drawn from said water pool between said rounded free end of said lip, and said portion of surfaces inside a water pool, under said vacuum head in contact with said rounded free end of said lip, and from 2 to 5 water jets within said confinement zone, and in close proximity but spaced from said portion of surfaces, directed to impinge each individually, a jet of water upon said portion of surfaces inside a water pool, under said vacuum head, said water of said water jets impinging water at an angle ranging from 30° to 60° with said portion of surfaces inside a water pool, within said confinement zone, and toward said water outlet, for said water from said water jets to hit at an angle ranging from 30° to 60° said portion of surfaces inside a water pool, under said vacuum head within said confinement zone, to remove dirt from said portion of surfaces, and said dirt together with said water, while being substantially confined within said confinement zone, to be displaced from said portion of surfaces, above said water jets and then be displaced toward said water outlet, along said flow of water moving from said pool, between said rounded free end of said lip, and said portion of surfaces inside a water pool in contact with said rounded free end of said lip, driven toward said water outlet.

2. The vacuum head for cleaning surfaces, inside a water pool, as defined in claim 1, wherein said water jets have an aperture ranging from ⅛ inch to ¼ inch in diameter and the distance of the water jets from the water outlet is from 1 to 3 inch.

3. A manually displaceable, shallow vacuum head for cleaning surfaces of the floor and adjacent sides, inside a water pool containing water, for using with water pool facilities having a water pump and a water source having substantially municipal water-tap pressures, said vacuum head comprising:

a top, a lip downwardly extending from said top, and terminating into a rounded free end, for contacting with a portion of surfaces inside a water pool, said rounded free end having a rounded peripheral cross-section, said lip defining with said top, and in cooperation with a portion of surfaces inside a water pool, under said vacuum head, a shallow confinement zone within said vacuum head, a water outlet away from said portion of surfaces, having one end and another end, said one end connected through said top within said lip, and said another end for joining a water pump generating a vacuum, said lip cooperating with said top and said water outlet to create a negative pressure between said top, said rounded free end of said lip, and said portion of surfaces inside a water pool, under said vacuum head, from 2 to 5 water jets disposed between said lip and said water outlet, and in close proximity but spaced from said portion of surfaces, directing water toward said portion of surfaces inside a water pool, at an angle ranging from 30° to 60° with said portion of surfaces inside a water pool, within said shallow confinement zone, under said vacuum head, and in a direction toward said water outlet, whereby the presence of water in said shallow confinement zone, generates a flow of water driven away from said portion of surfaces inside a water pool, and toward water outlet, at least some of said water to be drawn from said water pool between said rounded free end of said lip, and said portion of surfaces inside a water pool in contact with said rounded free end of said lip, under said vacuum head, said jets hitting an angle ranging from 30° to 60° with said portion of surfaces inside a water pool, removing the dirt along said portion of surfaces to be cleaned in a water pool toward said water outlet, creating a suspension momentarily withheld above said water jets within boundaries as defined by said lip and said top, and then removed from said water pool via said water outlet along with said flow of water moving from said pool, between said rounded free end of said lip, and said portion of surfaces inside a water pool in contact with said rounded free end of said lip, driven toward said water outlet.

4. The vacuum head for cleaning surfaces, inside a water pool, as defined in claim 3, wherein said lip is continuous.

5. The vacuum head for cleaning surfaces, inside a water pool, as defined in claim 3, wherein said lip is discontinuous.

6. The vacuum head for cleaning surfaces, inside a water pool, as defined in claim 3, wherein said lip is a peripheral lip around said top.

7. The vacuum head for cleaning surfaces, inside a water pool, as defined in claim 3, wherein said lip is made up of at least one discontinuous tubular element having telescopically mounted therein a smaller tubular element.

8. The vacuum head for cleaning surfaces, inside a water pool, as defined in claim 3, having mounted thereon an angularly adjustable bendable two-section arm, comprising:

a first arm section having one end and the other end, and a second arm section having one end and the other end, said first arm section at said one end to be pivotally mounted to said top of said vacuum, said other end of said first arm being pivotally mounted to said one end of said second arm section, said other end of said second arm portion defining a handle, and means for releasably holding said first arm section relative to said second arm section, whereby said handle is inclined with respect to said first arm section for said handle to be oriented at a suitable angle relative to the vacuum head.

9. The vacuum head for cleaning surfaces, inside a water pool, as defined in claim 3, wherein said top has a front and a rear, and said front and rear have a mid point, and said mid point of said front and of said rear of said top, when joined, defining a symmetrical line, said symmetrical line having also a midpoint, and said water outlet merging into said top, and being flush therewith, as to define with said top a continuous top surface for said shallow confinement zone, and said outlet being positioned along said symmetrical line, adjacent to said midpoint of said symmetrical line.

10. The vacuum head for cleaning surfaces, inside a water pool, as defined in claim 3, wherein said top is a member selected from the group consisting of semicircular flat plates, and rectangular flat plates.

11. The vacuum head for cleaning surfaces, inside a water pool, as defined in claim 3, wherein said top is a member selected from the group consisting of crescent-like flat plate and semicircular flat plate, said plate having a circular front, and said flat plate further includes weight equally disposed adjacent to said circular front, between said lip and at least some of said water jets.

12. The vacuum head for cleaning surfaces, inside a water pool, as defined in claim 3, wherein said lip is tubular.

13. The vacuum head for cleaning surfaces, inside a water pool, as defined in claim 3, wherein said vacuum head is a one-piece moulded vacuum head, a top, a lip downwardly extending from said top, and said lip defines therein a water passage, and said water jets are holes within said lip, said water passage having means for joining a water inlet.

14. The vacuum head for cleaning surfaces, inside a water pool, as defined in claim 3, wherein said vacuum head is a one-piece moulded vacuum head, a top, a lip downwardly extending from said top, and said lip defines therein a water passage, and said water jets are holes within said lip, said water passage having means for joining a water inlet, and said top is a semicircular flat plate, said plate having a circular front, and said flat plate further includes weights equally disposed adjacent said circular front, between said lip and said water jets, said weights being baffle means in said shallow confinement zone, acting as a first fence preventing escape of the dirt.

15. The vacuum head for cleaning surfaces, inside a water pool, as defined in claim 3, wherein said water jets disposed between said lip and said water outlet are near said lip.

16. The vacuum head for cleaning surfaces, inside a water pool, as defined in claim 3, wherein said water outlet is centered on said top, and said lip defines therein a water line and is perforated to define said water jets.

17. The vacuum head for cleaning surfaces, inside a water pool, as defined in claim 3, wherein said water jets have an aperture ranging from ⅛ inch to ¼ inch in diameter and the distance of the water jets from the water outlet is within 2±1 inch.

18. The vacuum head for cleaning surfaces, inside a water pool, as defined in claim 3, wherein said confinement zone further includes therein a member selected from the group consisting of scrubbing and brushing devices disposed away from the paths traced out by the water of said water jets to said water outlet.

19. A method for cleaning surfaces of the floor and adjacent sides inside a water pool, said method comprising:

with a manually displaceable vacuum head to be used with water pools containing water, and having a water pump and a water source having a water-tap pressure, said vacuum head having a top, and a lip mounted on said vacuum head, downwardly extending from said vacuum head, and terminating into a free end, for contacting with a portion of surfaces inside a water pool, said free end having a rounded peripheral cross-section, said vacuum head defining with said lip, a shallow confinement zone with a portion of surfaces inside a water pool, under said vacuum head, and a water outlet in said confinement zone, away from said portion of surfaces, and connected to a water pump generating a vacuum, creating in said confinement zone a negative pressure zone, resulting in a flow of water driven toward said water outlet, and thus blocking displacement from the confinement zone to a water pool, and inside said negative pressure confinement zone, and in close proximity, but spaced from said portion of surfaces, directing from 2 to 5 water jets at an angle ranging from 30° to 60° with said portion of surfaces inside a water pool, within said confinement zone, and toward said water outlet impinging with each individual jet, a jet of water upon surfaces to be cleaned a water pool containing water, said water from said jets hitting said surfaces inside a water pool within said confinement zone, to remove dirt from said portion of surfaces, and said dirt together with said water from said jets and drawn with at least some water drawn from said water pool between said lip and said portion of surfaces inside a water pool, under said vacuum head in contact with said lip, substantially confining said dirt within said confinement zone, and displacing it along said flow of water driven toward said water outlet.

* * * * *